US006520151B2

(12) United States Patent
Desai et al.

(10) Patent No.: US 6,520,151 B2
(45) Date of Patent: Feb. 18, 2003

(54) FUEL INJECTION SYSTEM WITH COMMON ACTUATION DEVICE AND ENGINE USING SAME

(75) Inventors: Chetan J. Desai, Bloomington, IL (US); Xinshuang Nan, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/974,285

(22) Filed: Oct. 10, 2001

(65) Prior Publication Data

US 2002/0073968 A1 Jun. 20, 2002

Related U.S. Application Data

(62) Division of application No. 09/740,533, filed on Dec. 19, 2000, now Pat. No. 6,408,821.

(51) Int. Cl.[7] ..... F02M 47/02

(52) U.S. Cl. ..... 123/446; 123/450; 123/467

(58) Field of Search ..... 123/446, 447, 123/450, 456, 467, 496; 239/96, 533.3, 533.4, 533.5, 533.8, 5

(56) References Cited

U.S. PATENT DOCUMENTS

| | | | | |
|---|---|---|---|---|
| 3,416,506 A | * | 12/1968 | Steiger | 123/447 |
| 3,951,117 A | * | 4/1976 | Perr | 123/450 X |
| 4,167,168 A | | 9/1979 | Yamamoto | |
| 4,284,049 A | | 8/1981 | Chmela | |
| 4,418,671 A | | 12/1983 | Kelso et al. | |
| 4,471,740 A | | 9/1984 | Jourde et al. | |
| 4,640,252 A | | 2/1987 | Nakamura et al. | |
| 4,667,638 A | | 5/1987 | Igashira et al. | |
| 5,033,506 A | | 7/1991 | Bofinger et al. | |
| 5,133,645 A | | 7/1992 | Crowley et al. | |
| 5,156,132 A | * | 10/1992 | Iwanaga | 123/496 |
| 5,433,182 A | | 7/1995 | Augustin et al. | |
| 5,507,260 A | | 4/1996 | Hintzen | |
| 5,619,969 A | | 4/1997 | Liu et al. | |
| 5,664,545 A | * | 9/1997 | Kato et al. | 123/496 |
| 5,676,114 A | | 10/1997 | Tarr et al. | |
| 5,678,521 A | * | 10/1997 | Thompson et al. | 123/447 |
| 5,697,341 A | | 12/1997 | Ausman et al. | |
| 5,711,277 A | * | 1/1998 | Fuseya | 123/496 |
| 5,738,063 A | | 4/1998 | Pfuhl et al. | |
| 5,819,704 A | | 10/1998 | Tarr et al. | |
| 5,852,997 A | | 12/1998 | Vanderpoel | |
| 5,931,139 A | | 8/1999 | Mack | |
| 5,937,826 A | * | 8/1999 | Olson et al. | 123/447 |
| 6,112,721 A | * | 9/2000 | Kouketsu et al. | 123/447 |
| 6,328,017 B1 | * | 12/2001 | Heinz et al. | 123/467 |

OTHER PUBLICATIONS

Heavy Duty Diesel Engines—The Potential of Injection Rate Shaping for Optimizing Emissions and Fuel Consumption, presented by Messrs. Bernd Mahr, Manfred Dürnholz, Wilhelm Polach, and Hermann Grieshaber, Robert Bosch GmbH, Stuttgart, Germany, at the 21st International Engine Symposium, May 4–5, 2000, Vienna, Austria.

* cited by examiner

*Primary Examiner*—Tony M. Argenbright
(74) *Attorney, Agent, or Firm*—Liell & McNeil

(57) ABSTRACT

The present invention relates to engines having common rail fuel injection systems. In traditional common rail fuel injection systems, each fuel injector utilized by the fuel system includes its own solenoid. These individual solenoids must cooperate to ensure that the proper amount of fuel is being injected from each injector at the proper time. Having individual solenoids requires a multiple number of moving electrical components. In contrast to the traditional common rail fuel injection system, the fuel injection system of the present invention includes fuel injectors that are controlled in operation by a common electronic actuator that is positioned remote from the fuel injectors. Therefore, the present invention reduces the number of moving electrical components in the fuel injection system by reducing the need for individual solenoids for each fuel injector.

19 Claims, 11 Drawing Sheets

FUEL INJECTION SYSTEM WITH COMMON ACTUATION DEVICE AND ENGINE USING SAME

RELATION TO PRIOR APPLICATION

This application is a division of U.S. patent application Ser. No. 09/740,533, filed Dec. 19, 2000 and entitled FUEL INJECTION SYSTEM WITH COMMON ACTUATION DEVICE AND ENGINE USING SAME, now U.S. Pat. No. 6,408,821.

TECHNICAL FIELD

This invention relates generally to engines, and more particularly to common rail fuel injection systems that use a common electrical actuator(s) to control multiple fuel injectors.

BACKGROUND

Common rail fuel injection systems are becoming more widespread for use with diesel engines. One example of such a fuel injection system is shown and described in U.S. Pat. No. 5,133,645, which issued to Crowley et al. on Jul. 28, 1992. Crowley et al. includes an electronic control module and an electronic distribution unit which control a plurality of high pressure fuel supply pumps and fuel injectors. As with other traditional common rail fuel injection systems, each of the fuel injectors included in the Crowley et al. fuel injection system includes its own individual electrical actuator. In this and other common rail fuel injection systems, the individual electrical actuators must cooperate to ensure that the proper amount of fuel is injected from each injector at the proper time. While the Crowley fuel injection system has performed adequately, there is room for improvement. For instance, if the number of electrical actuators, or solenoids, could be reduced, this could benefit the fuel injection system in a number of ways. First, because the number of parts has been reduced, there are less parts that can fail during system operation and hinder system performance. Additionally, injector performance variability might be reduced. Any reduction in the number of moving and/or electrical components should improve system robustness.

The present invention is directed to overcoming one or more of the problems as set forth above.

SUMMARY OF THE INVENTION

In one aspect of the present invention, a fuel injector comprises an injector body with a needle control chamber disposed therein. A direct control needle valve is at least partially positioned in the injector body and includes a closing hydraulic surface exposed to fluid pressure in the needle control chamber. The fuel injector also comprises an unobstructed high pressure passage extending between the needle control chamber and outside the injector body. Also, the fuel injector comprises an unobstructed low pressure passage extending between the needle control chamber and outside the injector body.

In another aspect of the present invention a method of injecting fuel comprises the steps of opening a nozzle outlet of a fuel injector at least in part by relieving pressure on a closing hydraulic surface of a direct control needle valve. Restricting fuel flow to the nozzle outlet at least in part by positioning a flow restriction valve member in a first position. Unrestricting fuel flow to the nozzle outlet at least in part by positioning said flow restriction valve member in a second position. Finally, closing the nozzle outlet at least in part by increasing pressure on the closing hydraulic surface of the direct control needle valve.

In yet another aspect of the present invention, a fuel injection system comprises a high pressure fuel rail and a low pressure fuel drain. Also, the fuel injection system comprises a plurality of fuel injectors that each include a direct control needle valve and a common electrical actuator coupled to the plurality of fuel injectors.

DETAILED DESCRIPTION

Figure 1:
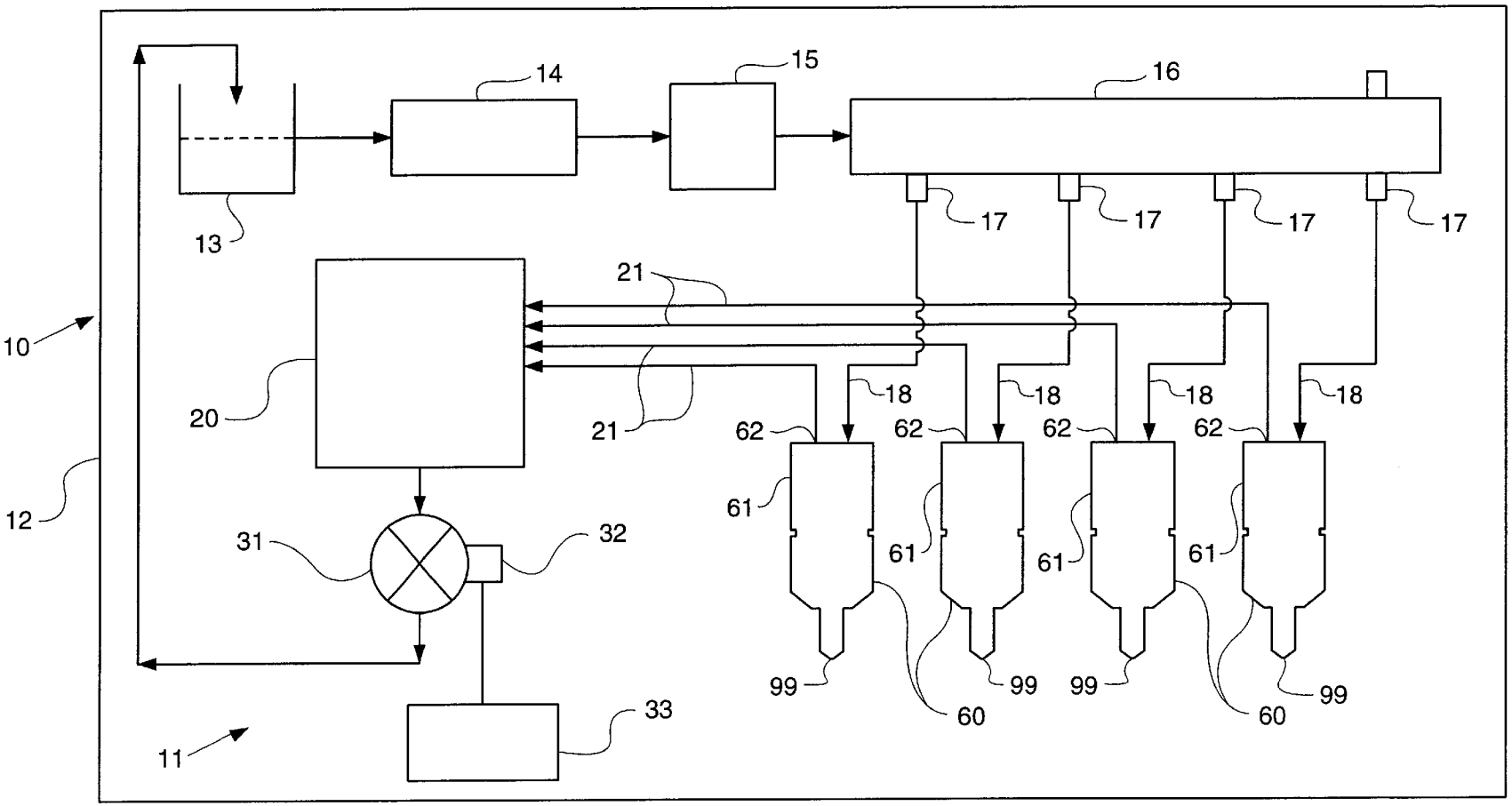
FIG. 1 is a schematic representation of a fuel injection system according to one embodiment of the present invention.

Referring now to FIG. 1, there is shown an engine 10 including a common rail fuel injection system 11 according to the present invention. Fuel injection system 11 is positioned within an engine housing 12 and includes a low pressure fuel drain, which is preferably a fuel tank 13, that is in fluid communication with a high pressure fuel rail 16. A high pressure pump 15 is positioned between fuel tank 13 and high pressure fuel rail 16, and is supplied with fuel from fuel tank 13 by a gear pump 14. High pressure fuel rail 16 includes a plurality of outlets 17 that are in fluid communication with an equal number of fuel injectors 60 via high pressure fuel supply lines 18.

Figure 2:
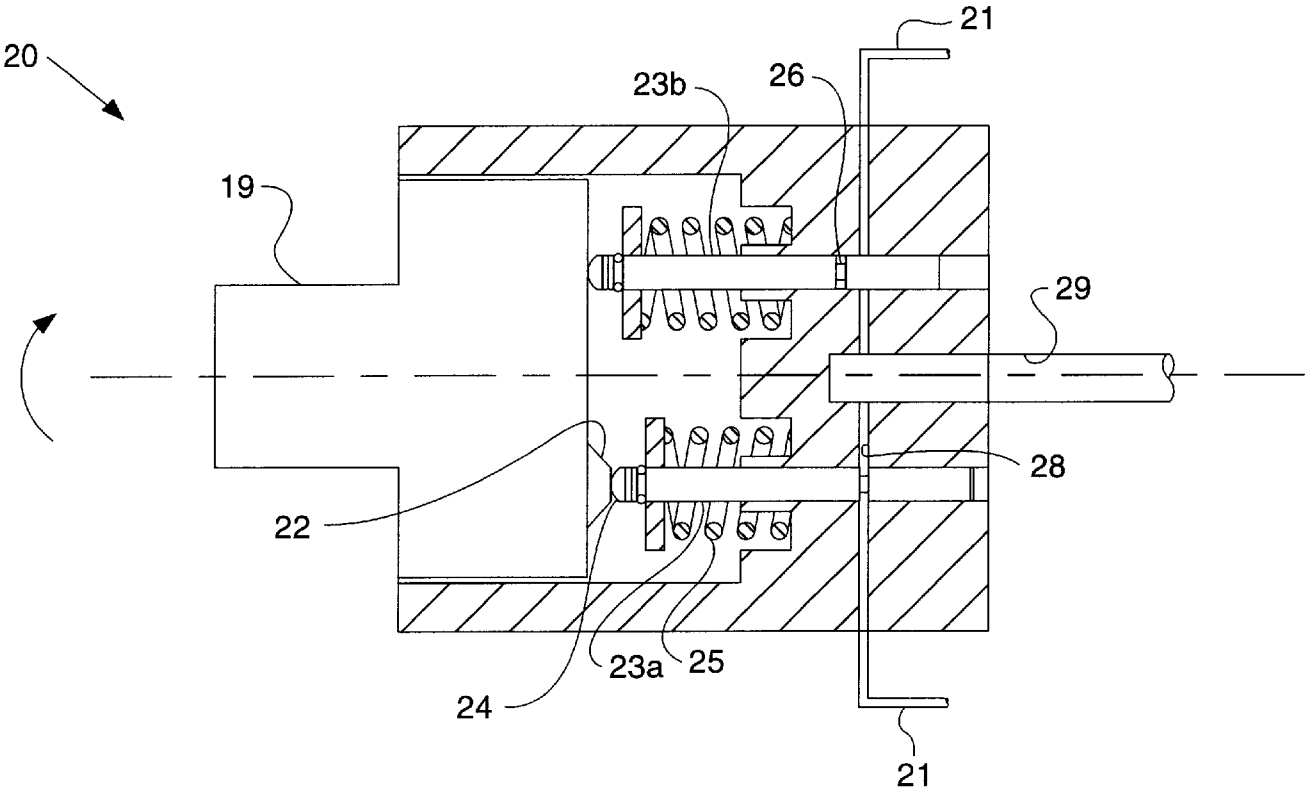
FIG. 2 is a sectioned diagrammatic representation of a fluid switch for use with the fuel injection system of FIG. 1.

Each fuel injector 60 includes an injector body 61 that defines a nozzle outlet 99 that can spray fuel into a combustion chamber of engine 10. Each fuel injector 60 also defines a pressure release drain 62 for reduction of internal pressure to allow injection to take place. A pressure release switch 20 is in fluid communication with each pressure release drain 62 via a series of drain passages 21. Cam 19 of pressure release switch 20 is driven by a crank and preferably rotates at one half the speed of the engine. Referring in addition to FIG. 2, there is shown a sectioned view of a preferred version of pressure release switch 20. Included in pressure release switch 20 are a number of spring biased valve members 23, equal to the number of fuel injectors 60 included in fuel injection system 11. Each valve member 23 is biased toward a first, or left, position by a biasing spring 25 and includes a contact surface 24, which is preferably a convex surface. As cam 19 rotates, a contact platform 22 is rotated which comes in contact with contact surface 24 of valve member 23. Contact platform 22 preferably includes sloped sides such that contact surface 24 can move smoothly over contact platform 22, to allow valve member 23 to make a smooth transition to its second, or right, position. When valve member 23 is in its biased, first position, an annulus 26, included on valve member 23 is out of fluid communication with drain passage 21 and a main passage 29, as illustrated in FIG. 2 by valve member 23*b*. However, when valve member 23 is in its second position, such as valve member 23*a*, annulus 26 is open to main passage 29 and drain passage 21 via drain passage 28.

When annulus 26 is open to drain passage 28 for a particular fuel injector 60, that fuel injector 60 is capable of being connected to fuel tank 13 via main passage 29. Therefore, only one fuel injector 60 can be connected to fuel tank 13, at a time, depending on the position of cam 19 in relation to pressure release switch 20. However, fuel injector 60 is not connected to fuel tank 13 via main passage 29 until a pressure release electronic actuator 32 is activated by an electronic control module 33. Pressure release electronic actuator 32 is attached to a pressure release electronic control valve 31 that is positioned remote from fuel injectors 60. Pressure release electronic actuator 32 is preferably a two position control valve. Pressure release electronic control valve 31 is moved from a biased, closed position to an open position when pressure release electronic actuator 32 is activated. While pressure release electronic actuator 32 is preferably a solenoid, it should be appreciated that other actuators, such as a piezoelectric actuator, could be substituted.

Figure 3:
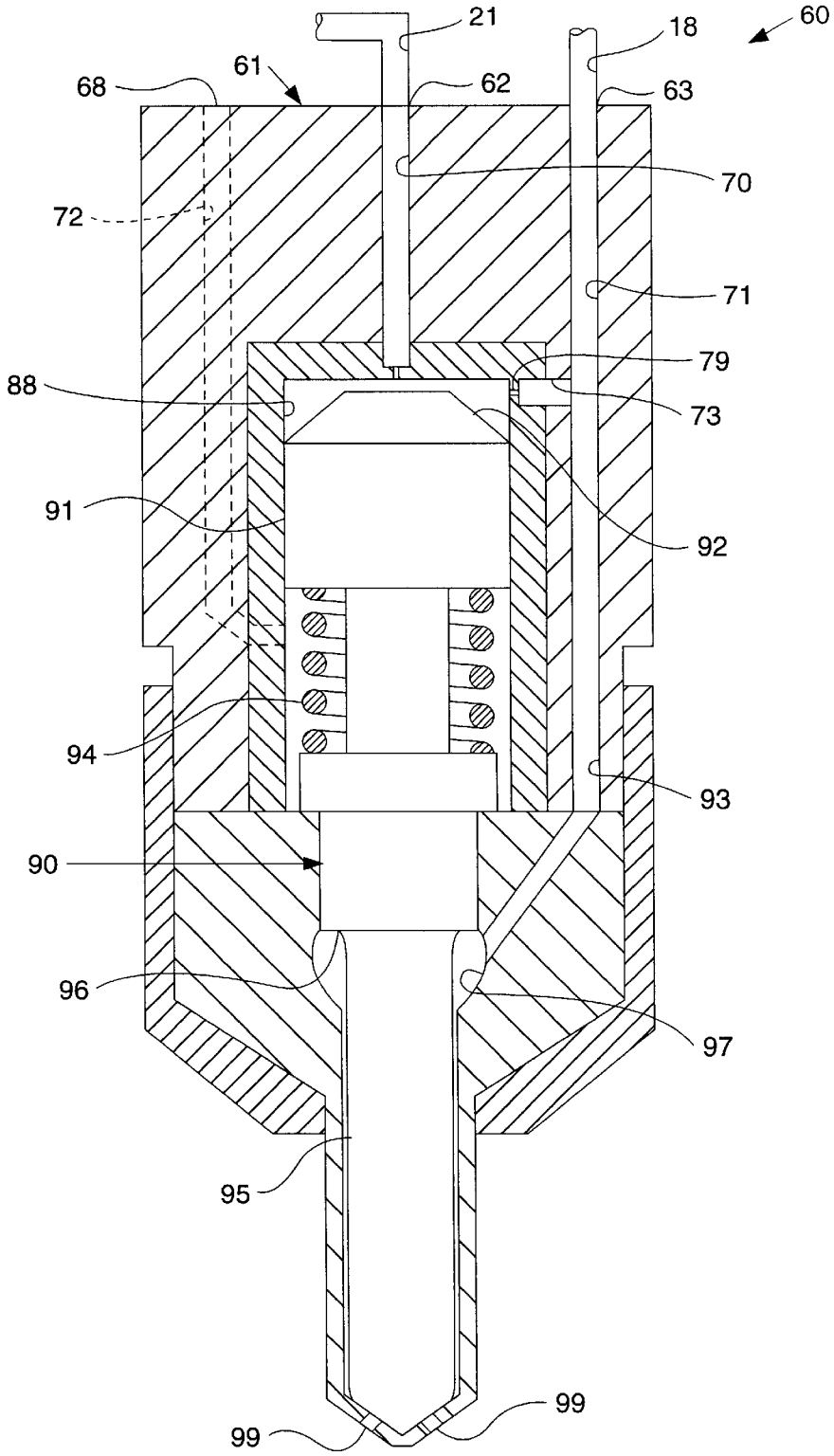
FIG. 3 is a sectioned diagrammatic representation of a fuel injector for use with the fuel injection system of FIG. 1.

Referring in addition to FIG. 3, there is shown a fuel injector 60 for use with fuel injection system 11. Fuel injector 60 includes an injector body 61 that defines a nozzle outlet 99, pressure release drain 62 and a high pressure fuel inlet 63. Pressure release drain 62, which is connected to drain passage 21, can fluidly connect a needle control chamber 88 with fuel tank 13, via a drain passage 70, when pressure release electronic actuator 32 is activated and pressure release electronic control valve 31 and pressure release switch 20 are appropriately positioned. High pressure fuel inlet 63 fluidly connects fuel injector 60 to high pressure fuel rail 16 via high pressure fuel supply line 18. A high pressure fuel passage 71 is defined by injector body 61 and includes a needle control passage 73 and a nozzle supply passage 93 which fluidly connect high pressure fuel inlet 63 to needle control chamber 88 and a nozzle chamber 97 respectively.

A direct control needle valve 90 is movably positioned in injector body 61 and includes a piston portion 91 and a needle portion 95. Needle valve 90 is movable between a downward position in which nozzle outlet 99 is closed and an upward position in which nozzle outlet 99 is open. Needle valve 90 is biased toward its downward position by a biasing spring 94. Needle valve 90 includes an opening hydraulic surface 96 that is exposed to fluid pressure within nozzle chamber 97. A closing hydraulic surface 92 of needle valve 90 is included on piston portion 91 and is exposed to fluid pressure within needle control chamber 88. A small diameter portion 79 included on needle control passage 73 limits the amount of high pressure fuel that can flow into needle control chamber 88 above piston portion 91. Small diameter portion 79 is sized to communicate pressure while simultaneously limiting flow volume therethrough. Piston portion 91 and needle control chamber 88 are preferably sized such that a match clearance exits between piston portion 91 and injector body 61. Preferably, this will prevent fuel from flowing around piston portion 91 toward biasing spring 94. However, because some fuel could migrate downward toward biasing spring 94 during the movement of needle valve 90, injector body 61 preferably defines a drain passage 72 that fluidly connects needle control chamber 88 to a drain 68 to vent any fuel that flows below piston portion 91 from fuel injector 60.

When pressure release drain 62 is blocked from fluid communication with fuel tank 13, high pressure fuel can act on both closing hydraulic surface 92 and opening hydraulic surface 96. Closing hydraulic surface 92 and opening hydraulic surface 96 are preferably sized such that needle valve 90 will remain in its downward, biased position to close nozzle outlet 99 when pressure release drain 62 is blocked from fuel tank 13. When pressure release drain 62 is open to fuel tank 13 via drain passage 21, high pressure fuel in needle control chamber 88 can flow out of fuel injector 60 through drain passage 70. In other words, when pressure release drain 62 is open to fuel tank 13, high pressure fuel rail 16 is fluidly connected to fuel tank 13 via needle control chamber 88 and drain passages 70, 21. However, recall that small diameter portion 79 of needle control passage 73 limits flow volume into needle control chamber 88. When needle control chamber 88 is fluidly connected to fuel tank 13, fuel pressure acting on opening hydraulic surface 96 is sufficient to overcome the downward bias exerted by biasing spring 94 and needle valve 90 can be moved toward its upward position to open nozzle outlet 99.

Figure 4:
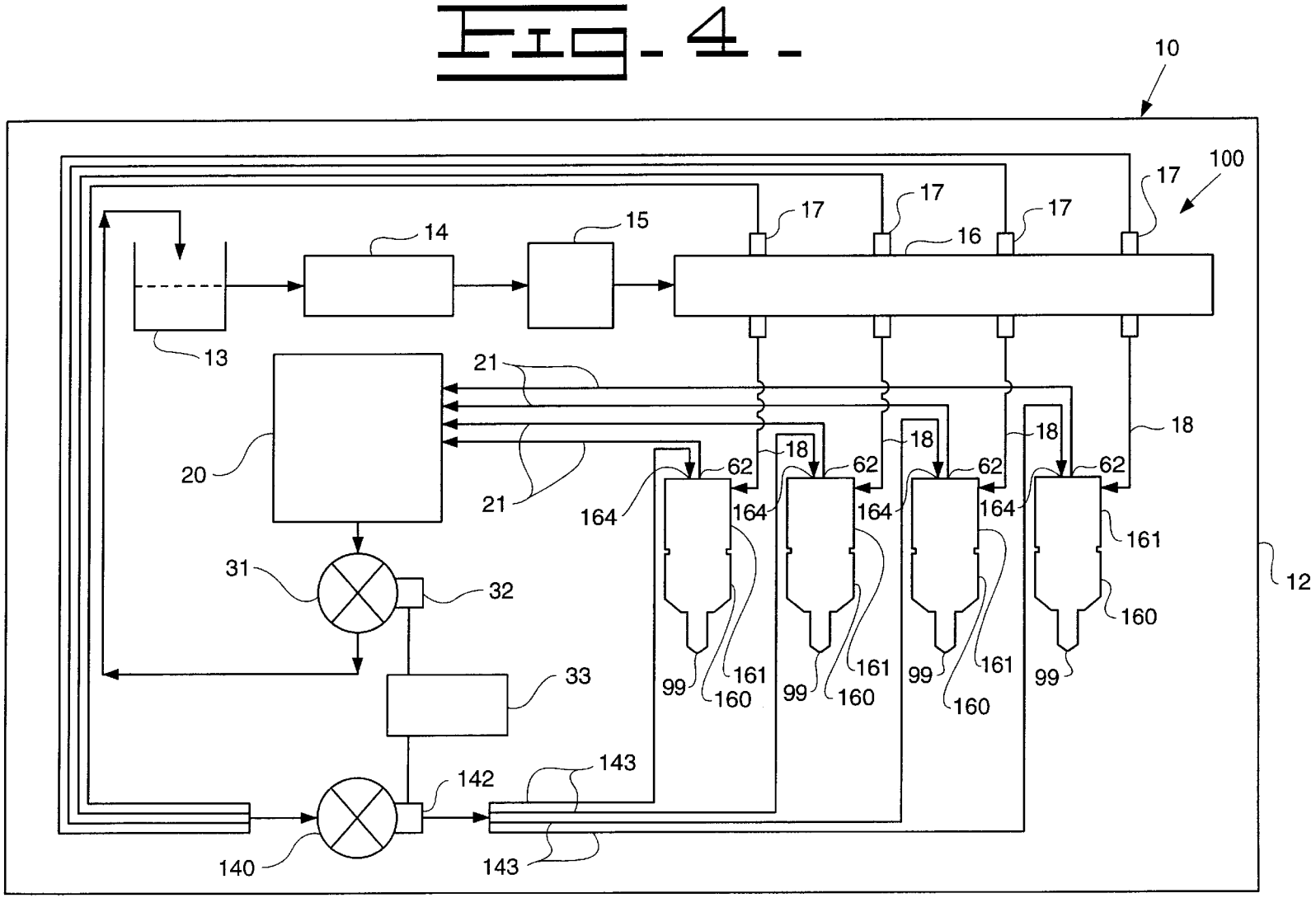
FIG. 4 is a schematic representation of a fuel injection system according to another embodiment of the present invention.
Figure 5:
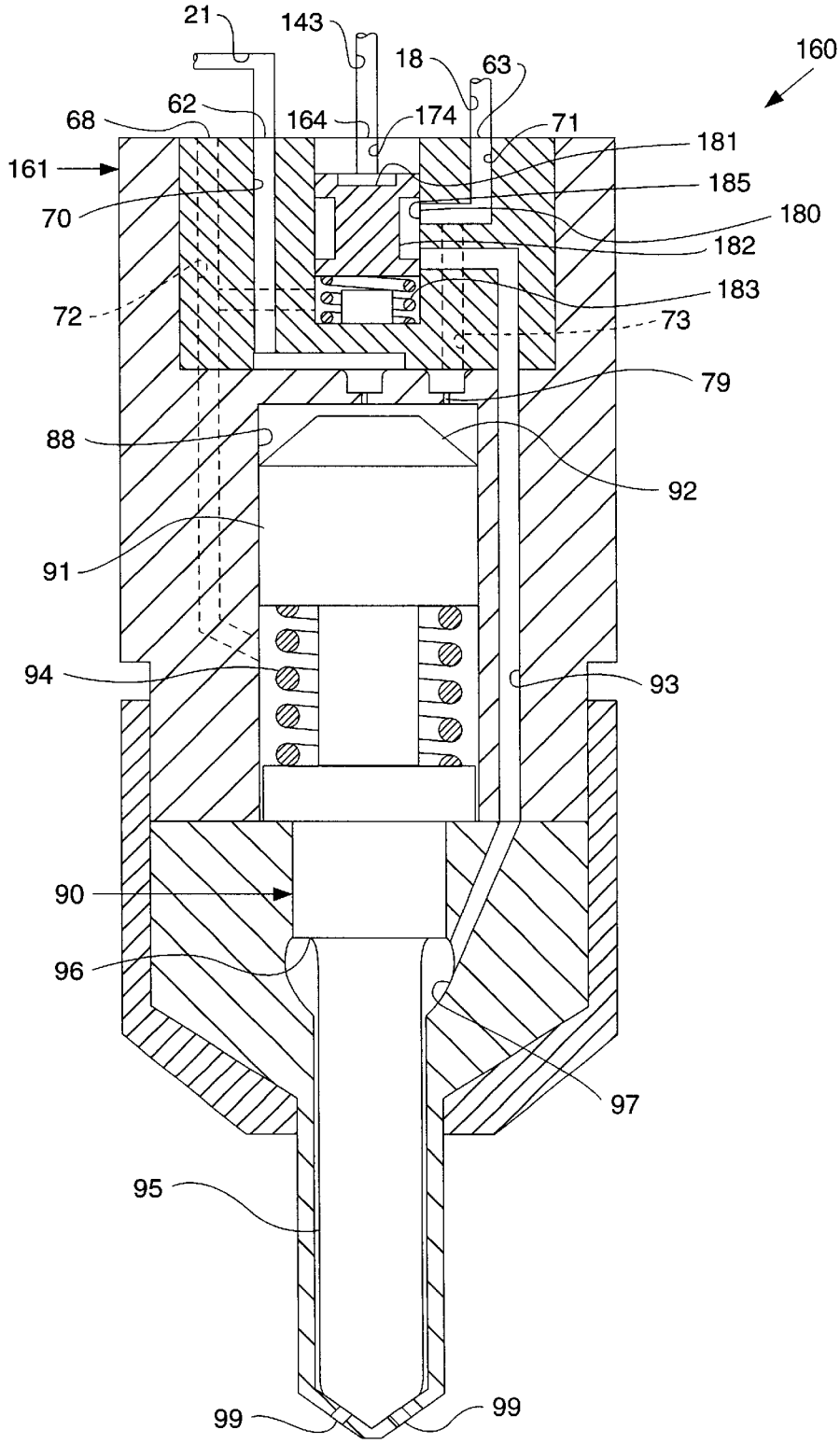
FIG. 5 is a sectioned diagrammatic representation of a fuel injector for use with the fuel injection system of FIG. 4.

Referring to FIGS. 4 and 5, there is shown a common rail fuel injection system 100 and fuel injector 160 according to an alternate embodiment of the present invention. Fuel injection system 100 and fuel injector 160 are similar to fuel injection system 11 and fuel injector 60, respectively. Therefore, like reference numerals have been used to denote like components, and a repeated description of like components will not be provided. With minor modification, fuel injection system 100 could be incorporated into engine 10 to make a complete engine. In addition to the fuel injection system components shown and described in the FIG. 1 embodiment, fuel injection system 100 includes a rate shaping electronic control valve 140 that is operably connected to electronic control module 33 and includes a rate shaping electronic actuator 142, which is preferably a two position solenoid, but could be another electronic actuator, such as a piezoelectric actuator. Rate shaping electronic control valve 140 is preferably a two position control valve and is positioned remote from each fuel injector 160 fluidly between high pressure fuel rail 16 and a rate shaping fuel inlet 164 of each fuel injector 160. When rate shaping electronic actuator 142 is activated by electronic control module 33, rate shaping electronic control valve 140 is moved from a biased, closed position toward an open position. When rate shaping electronic control valve 140 is in its open position, rate shaping fluid inlet 164 is fluidly connected to high pressure fuel rail 16 via a high pressure fluid passage 143. When rate shaping electronic control valve 140 is in this position, high pressure fuel can flow into a rate shaping fluid passageway 174, defined by injector body 161, via rate shaping fluid inlet 164 to change the position of a flow restriction valve member 180 that is movably positioned in injector body 161.

High pressure fuel flowing into rate shaping fluid passageway 174 can act on flow restriction valve member 180. Flow restriction valve member 180 is preferably any suitable valve member, such as a spool valve member, and includes a hydraulic surface 181 that is exposed to fluid pressure in rate shaping fluid passageway 174. Flow restriction valve member 180 is movable between an upward, retracted position and a downward, advanced position and is biased toward its upward position by a biasing spring 183. When flow restriction valve member 180 is in its retracted position, an annulus 182 included on flow restriction valve member 180 allows for unrestricted flow of fuel from high pressure fuel inlet 63 into nozzle supply passage 93. When flow restriction valve member 180 is in its advanced position, annulus 182 partially blocks high pressure fuel inlet 63 from nozzle supply passage 93, as illustrated in FIG. 5, to create a flow restriction 185 relative to nozzle outlet 99.

Flow restriction 185 reduces the amount of high pressure fuel that is flowing into nozzle chamber 97, thus reducing the fuel pressure exerted on opening hydraulic surface 96. Therefore, when flow restriction valve member 180 is in its advanced position, fuel injector 160 will inject fuel at a lower pressure than it will when flow restriction valve member 180 is in its retracted position. While the size of annulus 182 can be varied to alter injection pressure when flow restriction valve member 180 is in its advanced position, it should be appreciated that annulus 182 could be sized so large that flow restriction 185 has little or no effect on the pressure of fuel flowing into nozzle chamber 97. Similarly, annulus 182 could be sized small enough that fuel pressure in nozzle chamber 97 cannot be sustained above a valve opening pressure. Therefore, annulus 182 should be sized such that a valve opening pressure can be sustained when flow restriction 185 is present in nozzle supply passage 93, while still achieving the desired, lower injection pressure.

Note that unlike pressure release electronic control valve 31, rate shaping electronic control valve 140 is not prevented from affecting conditions within all fuel injectors 160. This is because rate shaping electronic control valve 140 is not separated from the injectors by a switch, such as pressure release switch 20. It should be appreciated that this should not effect fuel injection, or which fuel injector is injecting fuel, because pressure introduced into non-injecting fuel injectors 160 as a result of the position of rate shaping electronic control valve 140 merely changes the position of flow restriction valve member 180. In other words, the pressure forces acting on closing hydraulic surface 92 and opening hydraulic surface 96 are unaffected by the movement of rate shaping electronic control valve 140. Therefore, movement of rate shaping electronic control valve 140 to its open position should not cause a non-injecting fuel injector to inject fuel at an undesirable time. It should be appreciated, however, that a switch could be included to allow rate shaping electronic control valve 140 to connect only the injecting fuel injector 160 to high pressure fuel rail 16 during the injection event without departing from the spirit of the present invention.

Figure 6:
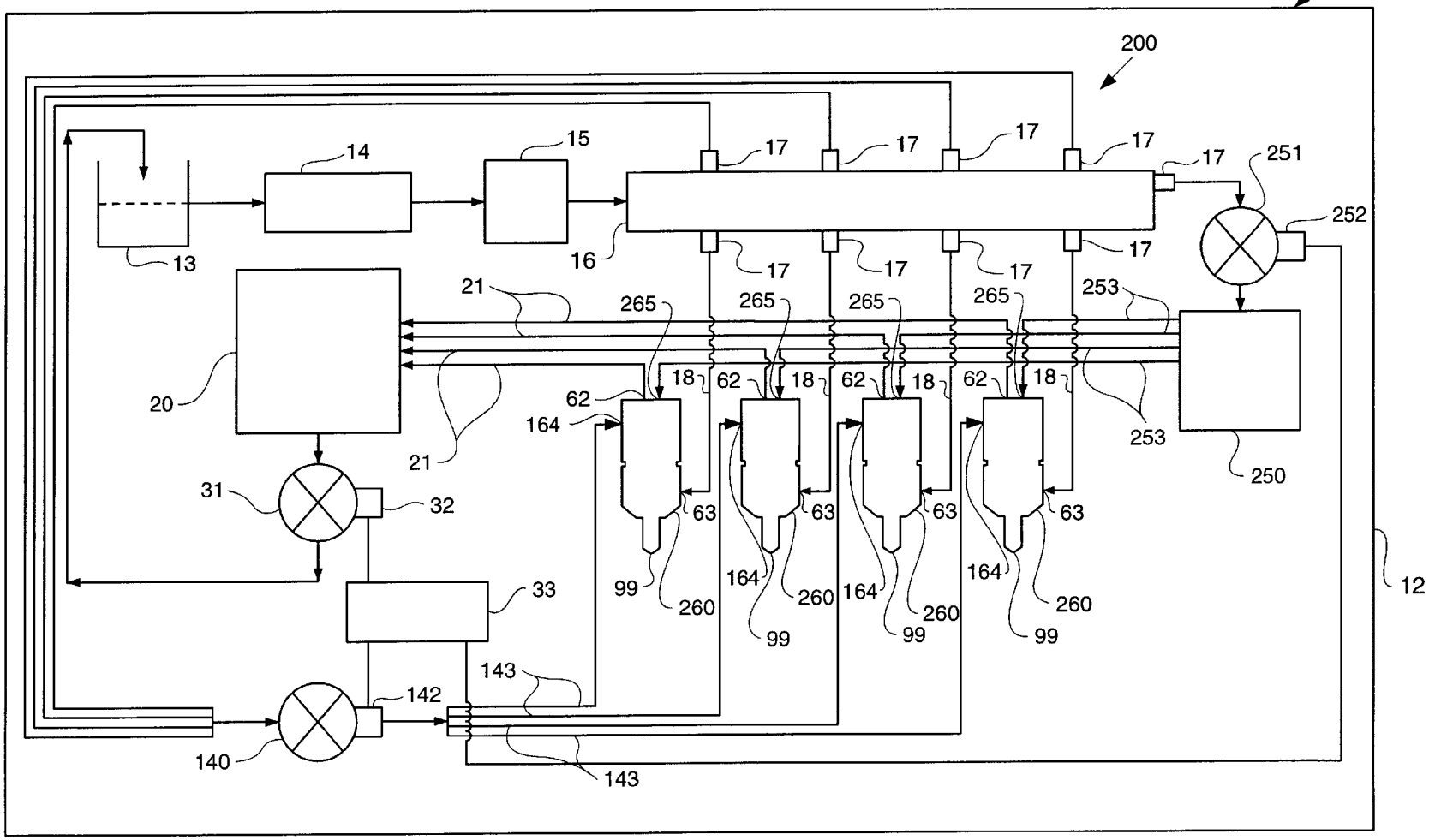
FIG. 6 is a schematic representation of a fuel injection system according to yet another embodiment of the present invention.
Figure 7:
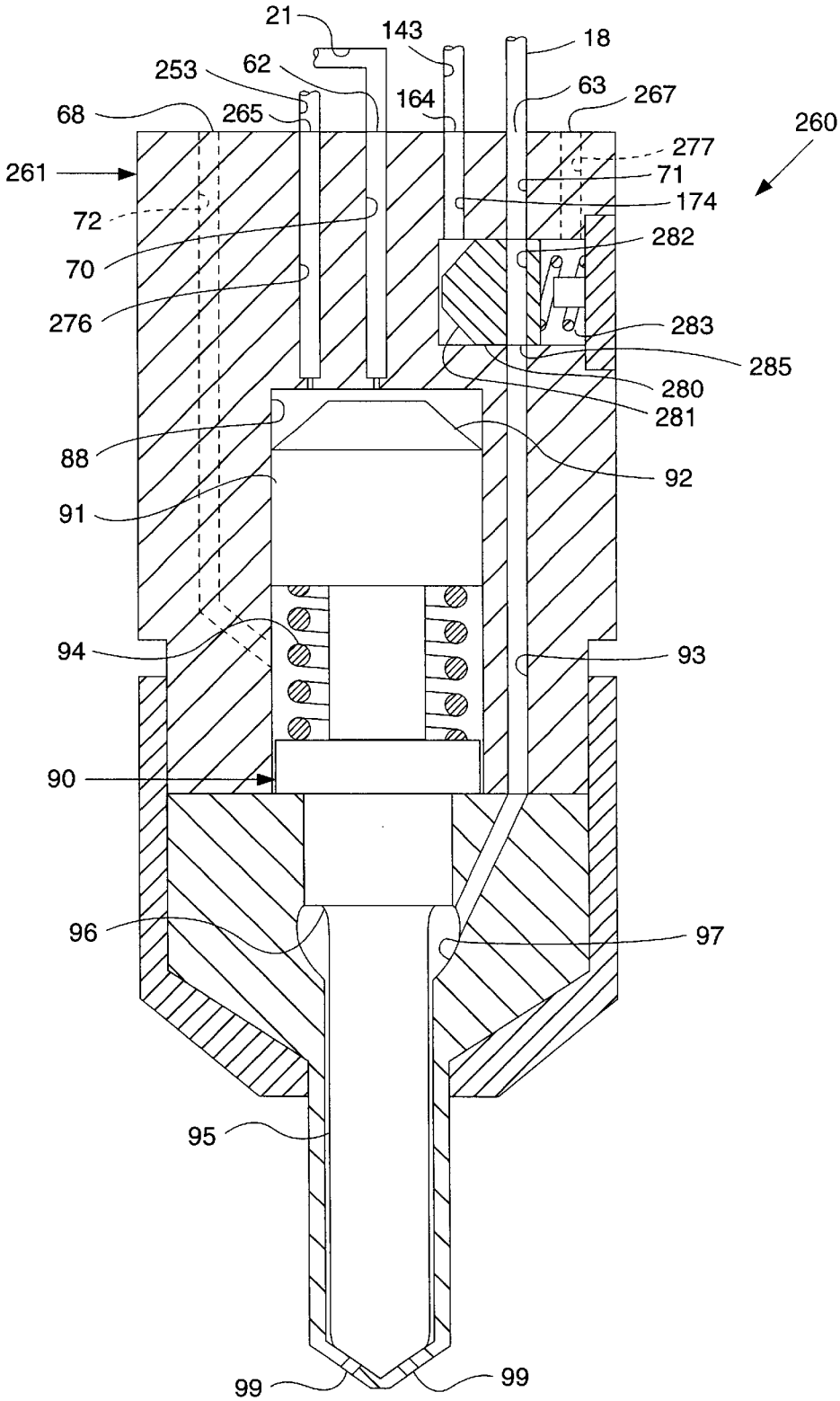
FIG. 7 is a sectioned diagrammatic representation of a fuel injector for use with the fuel injection system of FIG. 6.

Referring to FIGS. 6 and 7, there is shown a common rail fuel injection system 200 and fuel injector 260 according to yet another embodiment of the present invention. This embodiment of the present invention is the preferred mode for carrying out the invention, as it provides an even greater control over the injection event than the previous embodiments. Fuel injection system 200 is similar to fuel injection systems 11 and 100 and fuel injector 260 shares several common features with fuel injectors 60 and 160. Therefore, like numerals have been used to denote like components. With minor modification, fuel injection system 200 could be incorporated into engine 10 to create a complete engine. Because fuel injection system 200 and fuel injector 260 share common features with the previously disclosed embodiments, a repeated description of like components has not been provided.

In addition to the features shown and described for fuel injection system 100, fuel injection system 200 includes a pressure build-up switch 250 which is positioned fluidly between the rail outlet 17 of high pressure fuel rail 16 and each high pressure fuel inlet 265 of the fuel injectors 260. Pressure build-up switch 250 allows selective fluid communication between nozzle chamber 88 of a fuel injector 260 and high pressure fuel rail 16 via high pressure supply lines 253. Pressure build-up switch 250 is preferably similar to pressure release switch 20 in both form and function. However, while pressure release switch 20 can connect one fuel injector 260 to fuel tank 13 via drain passage 21 and main passage 29 to begin an injection event, pressure build-up switch 250 can connect a high pressure fuel inlet 265 of one fuel injector 260 to high pressure fuel rail 16 to end an injection event. A pressure build-up electronic control valve 251 controls fuel flow between high pressure fuel rail 16 and fuel injectors 260 via pressure build-up switch 250. Pressure build-up electronic control valve 251 is positioned remote from fuel injectors 260 and includes a pressure build-up electronic actuator 252. Pressure build-up electronic control valve 251 is preferably a two position control valve and is biased to a closed position. When pressure build-up electronic actuator 252 is activated by electronic control module 33, pressure build-up electronic control valve 251 is moved to an open position. As with pressure release electronic actuator 32 and rate shaping electronic actuator 142, pressure build-up electronic actuator 252 is preferably a solenoid, however, other electronic actuators, such as a piezoelectric actuator, could be substituted.

Referring in addition to FIG. 7, unlike fuel injectors 60 and 160, high pressure fuel passage 71 of fuel injector 260 does not include branch passages that open into both needle control chamber 88 and nozzle chamber 97. Instead, high pressure fuel passage 71 includes only nozzle supply passage 93 which opens into nozzle chamber 97. Injector body 261 defines a high pressure fuel passage 276 that fluidly connects high pressure fuel rail 16 to needle control chamber 88, via high pressure fuel inlet 265. Because high pressure fuel is entering needle control chamber 88 and nozzle chamber 97 from separate fuel inlets, it is possible to close needle control chamber 88 from high pressure fuel rail 16 without affecting fuel flow to nozzle chamber 97 or otherwise affecting injector performance. Recall that with the fuel injectors 60, 160 of the previous embodiments, needle control chamber 88 was continuously open to high pressure fuel rail 16 via high pressure fuel passage 71. However, in this embodiment of the present invention, pressure build-up switch 250 and pressure build-up electronic control valve 251 can be positioned and activated such that the needle control chamber 88 of a particular fuel injector 260 is closed from high pressure fuel rail 16 prior to opening needle control chamber 88 to fuel tank 13.

Returning to fuel injector 260, a flow restriction valve member 280 is movably positioned in injector body 261 and includes an internal passage 282 that can introduce a flow restriction 285 into nozzle supply passage 93. Flow restriction valve member 280 is preferably any suitable valve member, such as a spool valve member and is biased to fully open high pressure fuel passage 71 to nozzle supply passage 93 by a biasing spring 283. When rate shaping inlet 164 is fluidly connected to high pressure fuel rail 16, flow restriction valve member 280 moves against the bias of spring 283 to a position in which flow restriction 285 is introduced into nozzle supply passage 93. While flow restriction valve member 280 is preferably sized to prevent fluid flow into the area surrounding biasing spring 283, injector body 261 also defines a drain 267 and a drain passage 277 that can vent any fuel that has migrated into the area surrounding biasing spring 283 from fuel injector 260. Additionally, it should be appreciated that internal passage 282 is preferably sized and positioned such that a valve opening pressure can be reached in nozzle chamber 97 when flow restriction 285 is present in nozzle supply passage 93 while allowing for the desired reduction in injection pressure.

INDUSTRIAL APPLICABILITY

Figure 8A:
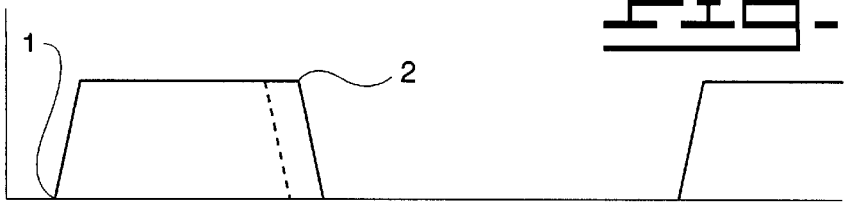
FIGS. 8*a–f* are graphs of pressure release switch position, pressure release actuator current, pressure release valve position, net force on the needle, needle position and injection rate, respectively, versus time for the fuel injector of FIG. 3 for one injection cycle.
Figure 8B:
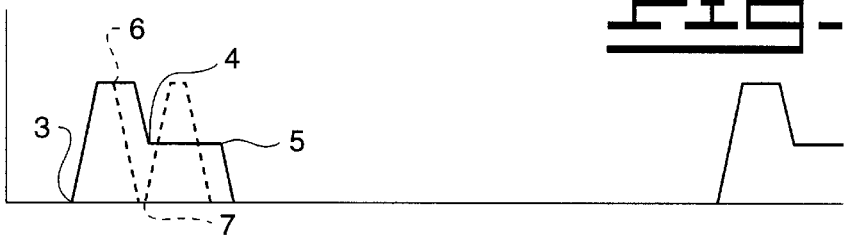
Figure 8C:
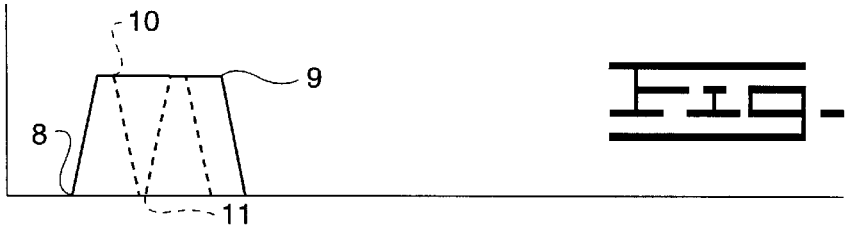
Figure 8D:
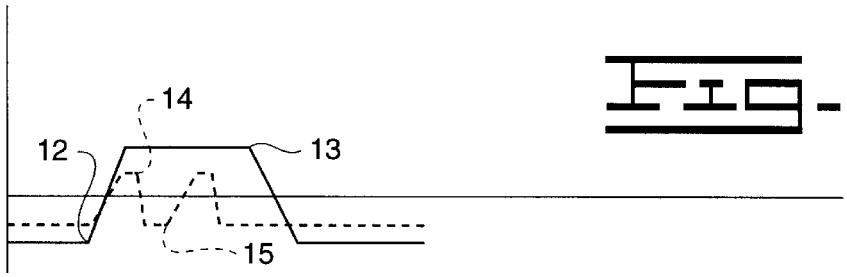
Figure 8E:
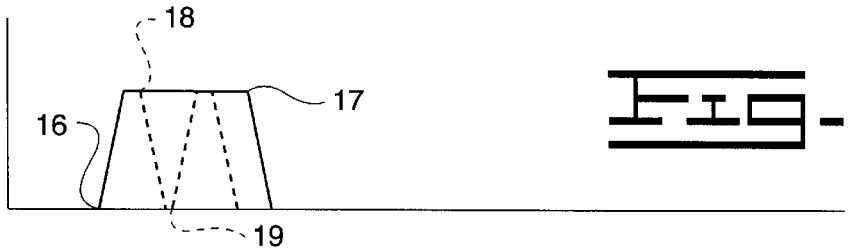
Figure 8F:
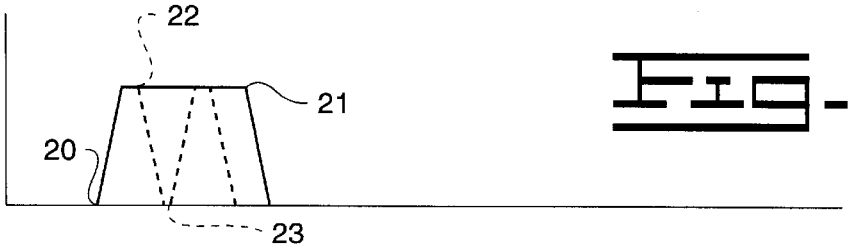

Referring to the FIGS. 1–3 embodiment of the present invention and in addition to the FIGS. 8*a–f* graphs of pressure release switch position, pressure release actuator current, pressure release valve position, net force on the needle, needle position and injection rate, respectively, versus time. Prior to an injection event, high pressure in needle control chamber 88 prevails and high pressure fuel is acting on both opening hydraulic surface 96 and closing hydraulic surface 92 of needle valve 90 such that needle valve 90 is in a downward position closing nozzle outlet 99, as illustrated in FIG. 8*d*. Cam 19 rotates such that a first valve member 23 moves over contact platform 22 to allow pressure release switch 20 to enable a first fuel injector 60 to be fluidly connected to fuel tank 13 via drain passage 21, as illustrated at 1 in FIG. 8*a*. Fuel injection from the first fuel injector 60 begins when pressure release electronic actuator 32 is activated by electronic control module 33 to move pressure release electronic control valve 31 to its open position as illustrated at 3 and 8 in FIGS. 8*b–c*, respectively.

When pressure release electronic actuator 32 is activated, the fuel injector 60 enabled by pressure release switch 20 becomes fluidly connected to fuel tank 13 via pressure release drain 62 and drain passage 21. However, pressure release electronic actuator 32 need not pull current for the entire injection event, and instead can be reduced to a hold level, as illustrated at 4 in FIG. 8*b*. High pressure fuel within needle control chamber 88 can flow out of fuel injector 60 via drain passage 70, thus reducing the pressure acting on closing hydraulic surface 92 of needle valve 90, as illustrated at 12 in FIG. 8*d*. Because high pressure fuel is still flowing into nozzle chamber 97, fuel pressure acting on opening hydraulic surface 96 exceeds a valve opening pressure and needle valve 90 moves to its upward position opening nozzle outlet 99 and allowing fuel to spray into combustion chamber 19, as illustrated at 16 in FIG. 8*e*. The corresponding increase in injection rate toward the maximum is illustrated at 20 in FIG. 8*f*.

As illustrated in FIG. 8, it is possible to create a split injection, such as when the engine is operating under idle operating conditions. Note that the injection characteristics for rated operating conditions have been graphed as solid lines while those for idle operating conditions have been graphed as dashed line. For instance, when current to pressure release electronic actuator 32 is ended, pressure release electronic control valve 31 closes briefly, as illustrated at 6 and 10 in FIGS. 8*b–c,* respectively. When pressure release electronic control valve 31 is closed, pressure can increase in needle control chamber 88 to a sufficient level to close needle valve 90. When pressure release electronic actuator 32 is re-activated (at 7 in FIG. 8*b*), pressure release electronic control valve 31 is reopened (at 11 in FIG. 8*c*). Pressure in needle control chamber 88 can again be vented, and needle valve 90 can reopen due to the fuel force exerted on opening hydraulic surface 96. The net force on the needle valve and this movement of the needle valve during the injection event has been illustrated at 14 and 15, and 18 and 19 in FIGS. 8*d–e*, respectively. In addition, the injection rate, and in particular the split injection created by the movement of needle valve 90 has been graphed at 22 and 23 in FIG. 8*f*.

The injection event of a particular fuel injector 60 is ended when pressure release electronic actuator 32 is deactivated, thus blocking needle control chamber 88 from communication with fuel tank 13 (at 5 in FIG. 8*b*). Pressure release electronic control valve 31 is now moved to its closed position, as illustrated at 9 in FIG. 8*c*. While high pressure fuel can no longer flow from needle control chamber 88, needle control chamber 88 is still exposed to high pressure in high pressure fuel rail 16 via first branch passage 73 and high pressure fuel inlet 63. Pressure acting on closing hydraulic surface 92 of needle valve 90 once again begins to build and subsequently, and the high fuel pressure acting on opening hydraulic surface 96 is no longer sufficient to hold needle valve 90 in its upward, open position. Needle valve 90 is returned to its downward position under the action of biasing spring 94 to close nozzle outlet 99 and the injection event is ended, as illustrated at 13, 17 and 21 in FIGS. 8*d–f*.

After needle valve 90 returns to its downward position to end the injection event for this fuel injector, fuel injection system 11 prepares a subsequent fuel injector 60 for fuel injection. The corresponding valve member 23 within pressure release switch 20 moves off of contact platform 22, as cam 19 continues to rotate, to prevent pressure release electronic control valve 31 from reopening needle control chamber 88 of that particular fuel injector 60 to fuel tank 13 (at 2 in FIG. 8*a*). Cam 19 continues to rotate and a second valve member 23 moves over contact surface 22 to enable the next fuel injector 60 to be fluidly connected to fuel tank 13 via needle control chamber 88 and drain passage 21. It should be appreciated that because only one fuel injector 60 is capable of being fluidly connected to fuel tank 13 via drain passage 21, fuel injection system 11 will have no more than one fuel injector 60 injecting fuel into combustion chamber 19 at any given time.

Figure 9A:
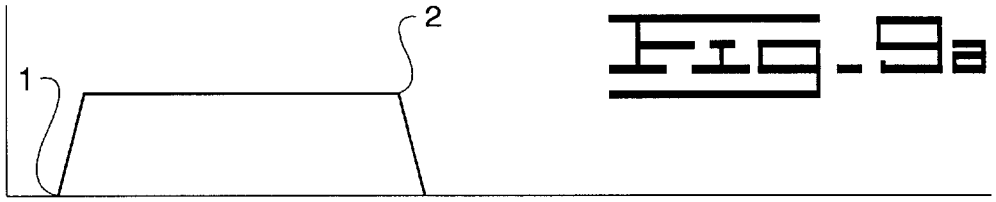
FIGS. 9*a–h* are graphs of pressure release switch position, pressure release actuator current, pressure release valve position, net force on the needle, flow area to the nozzle, injection rate, rate shaping actuator current and rate shaping valve position, respectively, versus time for the fuel injector of FIG. 5 for one injection cycle.
Figure 9B:
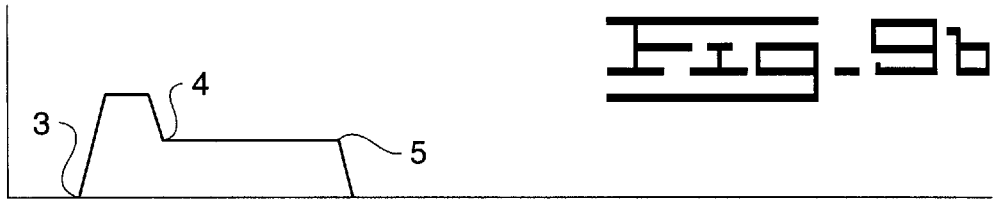
Figure 9C:
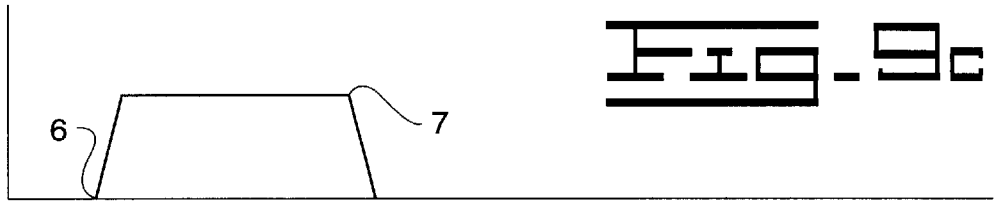
Figure 9D:
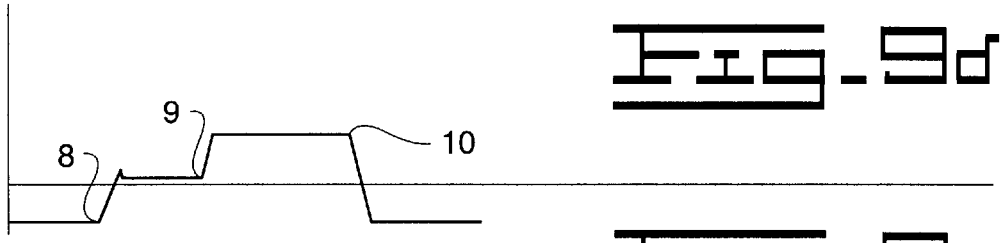
Figure 9E:
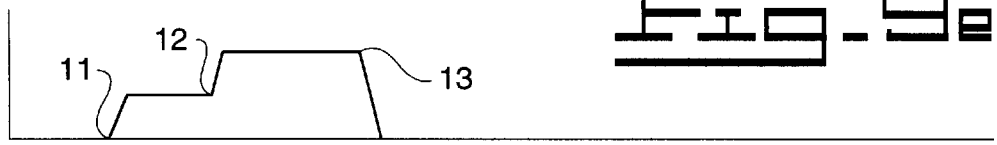
Figure 9F:
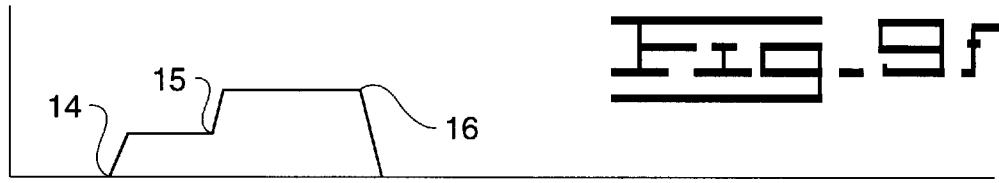
Figure 9G:
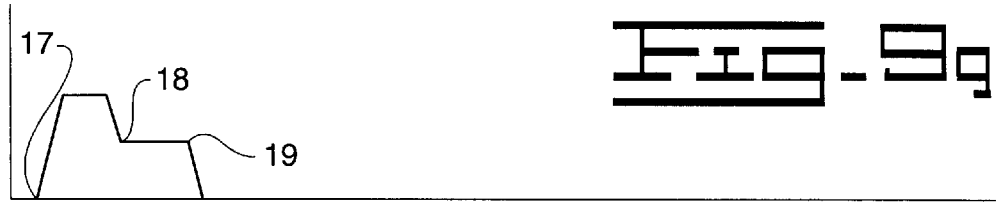
Figure 9H:
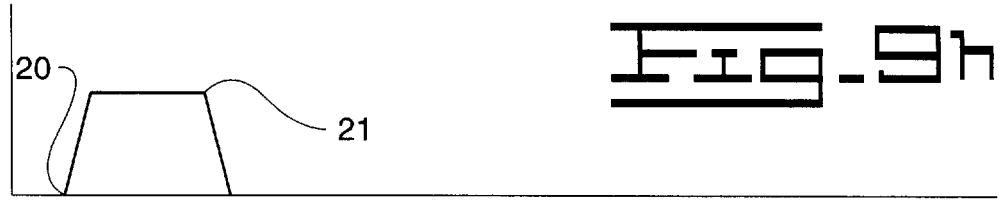

Referring now to the FIGS. 4–5 embodiment of the present invention and in addition to the graphs of pressure release switch position, pressure release actuator current, pressure release valve position and net force of needle valve 90, respectively, versus time of FIGS. 9*a–h*. Prior to an injection event, high pressure in needle control chamber 88 prevails and high pressure fuel is acting on closing hydraulic surface 92 and opening hydraulic surface 96, such that needle valve 90 is in its downward, closed position, as illustrated in FIG. 9*d*. Rate shaping electronic actuator 142 is preferably de-activated such that rate shaping inlet 164 is not connected to high pressure fuel rail 16, as illustrated in FIG. 9*g*. Low pressure is acting on hydraulic surface 181 and flow restriction valve member 180 is positioned in its upward, biased position, allowing unrestricted flow of fuel from high pressure fuel passage 71 to nozzle supply passage 93, as illustrated in FIG. 9*h*. Cam 19 is rotating at one half the speed of the engine and valve member 23 moves onto contact surface 22 to allow pressure release switch 20 to enable a first fuel injector 60 to be fluidly connected to fuel tank 13 (at 1 in FIG. 9*a*).

Prior to activation of pressure release electronic actuator 32, rate shaping electronic actuator 142 is preferably activated, and rate shaping electronic control valve 140 moves to its open position, as illustrated at 17 and 20, respectively in FIGS. 9*g–h*. Rate shaping inlet 164 is now open to high pressure fuel rail 16, via high pressure fuel passage 143 exposing hydraulic surface 181 of flow restriction valve member 180 to high pressure fuel. Flow restriction valve member 180 then moves toward its advanced position, causing a flow restriction 185 between high pressure fuel passage 71 and nozzle supply passage 93. Pressure release electronic actuator 32 is now activated to move pressure release electronic control valve 31 to its open position to allow the injection event to begin, as illustrated at 3 and 6 in FIGS. 9*b–e*. Corresponding movement of needle valve 90 toward its open position, increase in flow area to nozzle outlet 99 and initial injection rate are illustrated at 8, 11 and 14 in FIGS. 9*d–f*.

Operation of fuel injection system 100, and fuel injector 160, would be identical to that of fuel injection system 11 and fuel injector 60 if rate shaping electronic actuator 142 was not activated during fuel injection. As with pressure release electronic actuator 32, rate shaping electronic actuator 142 need not pull current for the duration of the injection event, and can instead be reduced to a hold level as illustrated at 4 and 1) in FIGS. 9*b* and 9*g*. At the desired point during the injection event, rate shaping electronic actuator 142 is de-activated and rate shaping electronic control valve 140 moves to its closed position to end fluid communication between rate shaping inlet 164 and high pressure fuel rail 16 (at 19 and 21 in FIGS. 9*g–h*). Flow restriction valve member 180 can now return to its biased, retracted position under the action of biasing spring 183. As flow restriction valve member 180 retracts, annulus 182 retracts in a corresponding manner such that fuel flow between high pressure fuel passageway 71 and nozzle supply passage 93 is unrestricted. This unrestricted flow into nozzle supply passage 93 increases the amount of fuel flowing into nozzle chamber 97, therefore increasing the pressure being exerted on opening hydraulic surface 96 and raising the pressure of fuel being injected by fuel injector 160 (at 9, 12 and 15 in FIGS. 9*d–f*). By varying the timing of rate shaping electronic actuator 142, it should be appreciated that a number of rate shapes, such as boot shapes, can be accomplished with fuel injection system 100. However, it should also be appreciated that at certain operating conditions it may be undesirable to have front end rate shaping. In these instances, rate shaping electronic actuator need not be activated, such that rate shaping electronic control valve remains in its closed position throughout the injection event.

As described for the FIGS. 1–3 embodiment of the present invention, fuel injection from fuel injector 160 is ended when current to pressure release electronic actuator 32 is ended and pressure release electronic control valve 31 returns to its closed position, as illustrated at 5 and 7, respectively, in FIGS. 9*b–c*. Needle control chamber 88 is now blocked from fluid communication with fuel tank 13 and pressure within needle control chamber 88 acting on closing hydraulic surface 92 can rise. Because of the size differential between closing hydraulic surface 92 and opening hydraulic surface 96, the high pressure acting on opening hydraulic surface 96 is no longer sufficient to hold needle valve 90 in its upward position, and needle valve 90 returns to its downward position under the action of biasing spring 94 (at 10 in FIG. 9*d*). Needle valve 90 is moved toward its downward movement by the increased pressure acting on closing hydraulic surface 92. The corresponding decrease in flow area to nozzle outlet 99 and in injection rate has been illustrated at 13 and 16 in FIGS. 9*e–f*, respectively. As with fuel injection system 11, after needle valve 90 returns to its downward position to end the injection event for this fuel injector 160, fuel injection system 100 prepares a subsequent fuel injector 160 for fuel injection. Cam 19 continues to rotate and first valve member 23 moves off of contact surface 22 to close pressure release switch 20 from enabling this fuel injector 160 from being fluidly connected to fuel tank 13 via needle control chamber 88 and drain passage 21, as illustrated at 2 in FIG. 9*a*. A second valve member 23 moves over contact surface 22 to enable the needle control chamber of the next fuel injector 160 to be fluidly connected to fuel tank 13.

Figure 10A:
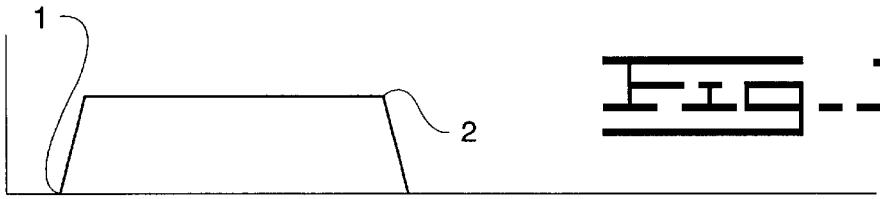
FIGS. 10*a–i* are graphs of pressure release switch position, pressure release actuator current, net force on the needle, flow area to the nozzle, injection rate, rate shaping valve position, pressure build-up actuator current, pressure build-up valve position and pressure build-up switch position, respectively, versus time for the fuel injector of FIG. 7 for one injection cycle.
Figure 10B:
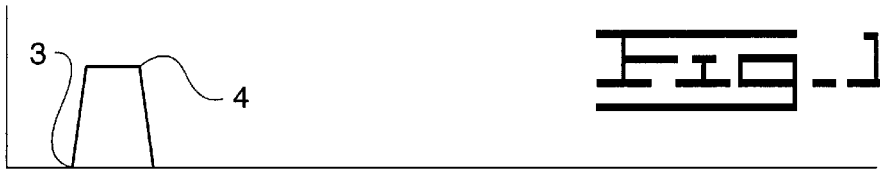
Figure 10C:
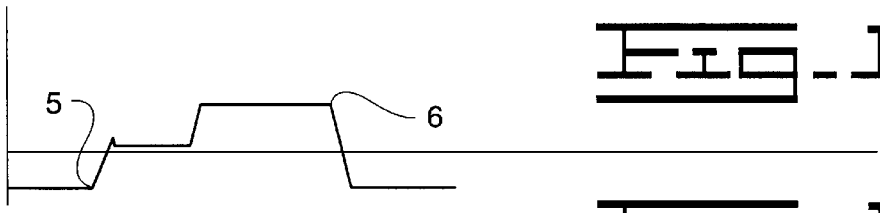
Figure 10D:
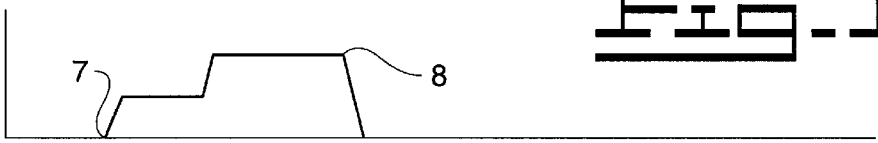
Figure 10E:
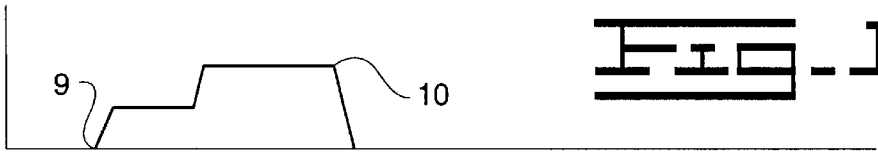
Figure 10F:
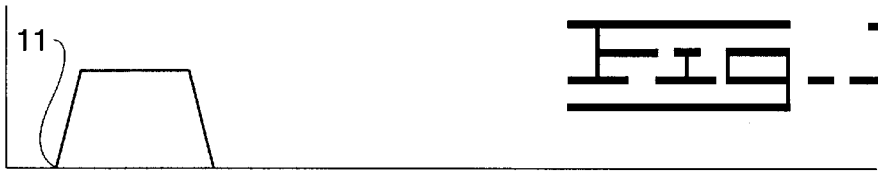
Figure 10G:
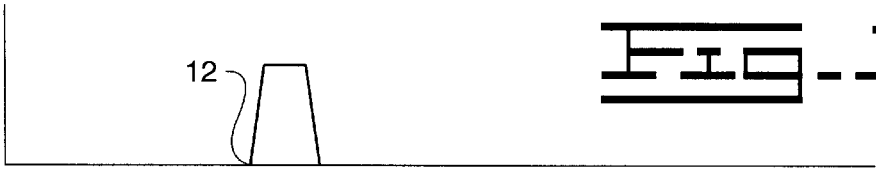
Figure 10H:
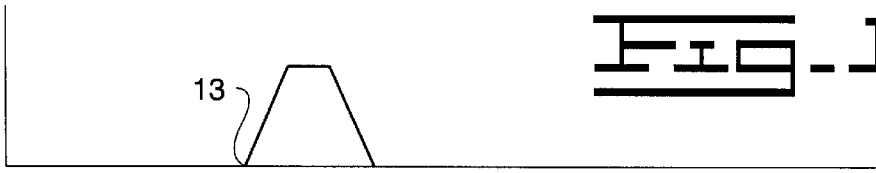
Figure 10I:
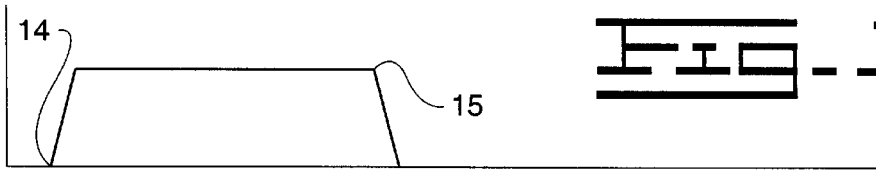

Referring to the FIGS. 6–7 embodiment of the present invention and in addition to the FIGS. 10*a–i* graphs of pressure release switch position, pressure release actuator current, net force on the needle, flow area to the nozzle, injection rate, rate shaping valve position, pressure build-up actuator current, pressure build-up valve position and pressure build-up switch position, respectively, versus time. Prior to an injection event, high pressure in needle control chamber 88 prevails, high pressure inlet 63 is open to high pressure fuel rail 16 to expose opening hydraulic surface 96 to high pressure and residual high pressure is acting on closing hydraulic surface 92 such that needle valve 90 is in a downward position closing nozzle outlet 99. Rate shaping inlet 164 is preferably not connected to high pressure fuel rail 16, such that low pressure acting on hydraulic surface 281 allows flow restriction valve member 280 to remain in its biased, retracted position, allowing an unrestricted flow path between high pressure fuel passage 71 and nozzle supply passage 93. Just prior to the initiation of an injection event, pressure build-up switch 250 enables the high pressure fuel inlet 265 of a first fuel injector 260 to be fluidly connected to high pressure fuel rail 16, as illustrated at 20 in FIG. 10*i*. However, because pressure build-up electronic control valve 251 remains in its closed position, as illustrated in FIG. 10*h*, high pressure fuel inlet 265 is not opened to high pressure fuel rail 16 at this time. Cam 19 now rotates such that pressure release switch 20 enables a first fuel injector 260 to be fluidly connected to fuel tank 13, as illustrated at 1 in FIG. 10*a*.

Prior to activation of pressure release electronic control valve 31, rate shaping electronic actuator 142 is preferably activated to move rate shaping electronic control valve 140 to an open position to fluidly connect rate shaping inlet 164 with high pressure fuel rail 16 (at 14 in FIG. 10*f*). Recall that at certain operating conditions, front end rate shaping may not be desirable. Therefore, it should be appreciated that fuel injection can take place if rate shaping electronic control valve 140 remains in its closed position. With high pressure now acting on hydraulic surface 281, flow restriction valve member 280 can move toward its advanced position against the action of biasing spring 283. The corresponding movement of internal passage 282 creates a flow restriction 285 in nozzle supply passage 93 that will create a lower injection pressure at the beginning of the injection event. The injection event is initiated by the brief activation of pressure release electronic actuator 32, as illustrated at 3 in FIG. 10*b*, which fluidly connects pressure release drain 62 to fuel tank 13. It should be appreciated that pressure release electronic actuator 32 does not need to receive current for the duration of the injection event, as it did for fuel injection systems 11 and 100, because it only takes a short amount of time to vent the residual pressure in needle control chamber 88. Also, only a small fixed amount of fuel must be displaced from needle control chamber 88 for fuel injection to proceed. Therefore, pressure release electronic control valve 31 need only be moved to its open position for a relatively short amount of time. Recall that in fuel injection systems 11 and 100, the needle control chambers 88 of the fuel injectors 60, 160 were continuously open to high pressure fuel rail 16, and as a result, pressure release electronic control valve 31 remained in an open position to allow fuel pressure above needle valve 90 to be vented for the duration of the injection event.

Once residual pressure within needle control chamber 88 has been vented, the high fuel pressure acting on opening hydraulic surface 96 can exceed a valve opening pressure defined by biasing spring 94. Needle valve 90 then moves to its upward, open position to commence fuel spray from nozzle outlet 99, as illustrated at 5 in FIG. 10*c*. Note, however, that flow area to nozzle outlet 90 increases only to a restricted amount due to flow restriction 185, as illustrated at 8 in FIG. 10*d*. The corresponding initial injection rate has been illustrated at 11 in FIG. 10*e*. Pressure release electronic actuator 142 is then deactivated (at 4 in FIG. 10(*b*)) to return electronic control valve 31 to its closed position to block needle control chamber 88 from fluid communication with fuel tank 13. Operation of fuel injector 260 and fuel injection system 200 progresses in a similar manner as that described for fuel injector 160 and fuel injection system 100, until just prior to the end of the injection event. At that time, pressure build-up electronic actuator 252 is activated briefly to move pressure build-up electronic control valve 251 to its open position, as illustrated at 16 and 18, respectively, in FIGS. 10*g–h*. High pressure fuel inlet 265 is once again fluidly connected to high pressure fuel rail 16 and high pressure fuel flows into needle control chamber 88 via high pressure fuel supply line 253. Because closing hydraulic surface 92 is again exposed to high pressure within nozzle chamber 88, needle valve 90 is moved to its downward, closed position to close nozzle outlet 99 and end the injection event, as illustrated at 7 in FIG. 10*c*. The corresponding decrease in flow area to nozzle outlet 99 and injection rate has been illustrated at 10 and 13, respectively, in FIGS. 10*d–e*.

After needle valve 90 moves to its downward position to end fuel injection from fuel injector 250, fuel injection system 200 prepares a subsequent fuel injector 260 to begin injection. Cam 19, which has been rotating throughout the previous injection event, rotates such that valve member 23 within pressure release switch 20, corresponding to the previously injecting fuel injector 260, moves off contact platform 22, and valve member 23 corresponding to the fuel injector that is about to inject moves on to platform 22 (at 2 in FIG. 10*a*). Preferably, at about the same time, the contact platform within pressure build-up switch 250 is rotated such that the valve member 23 corresponding to the previously injecting fuel injector 260 returns to its biased position, and the valve member 23 for the fuel injector 260 about to inject moves onto the contact platform (at 21 in FIG. 10*i*). The subsequent fuel injector 260 can now inject fuel in the manner described above.

Figure 11:
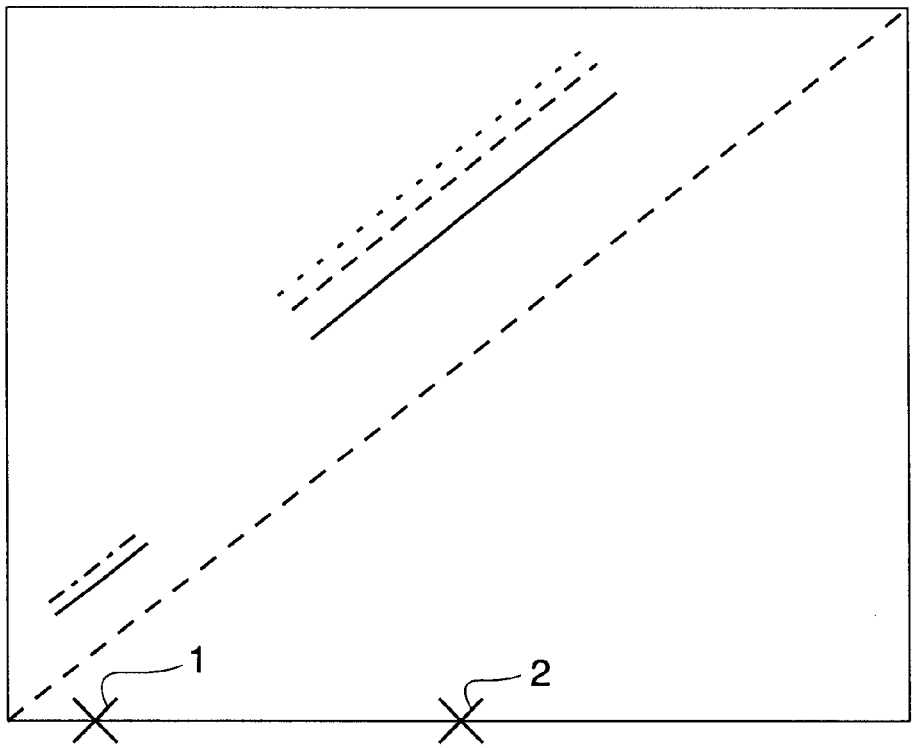
FIG. 11 is a graphical representation of total fuel consumption versus time for the fuel injection systems of FIGS. 1, 4 and 6.

Referring now to FIG. 11, total fuel consumption for fuel injection systems 11, 100 and 200 have been graphed versus time for both idle operating conditions, at 1, and for rated operating conditions, at 2. Note that the total amount of fuel consumed by fuel injection system 200, graphed as a solid line, is substantially less than that used by fuel injection systems 11 and 100, where these systems are represented by dashed and dotted lines, respectively. This result should be expected because pressure build-up switch 250 and pressure build-up electronic control valve 251 allow each fuel injector to be blocked from fluid communication with high pressure rail 16 prior to being fluidly connected to fuel tank 13. Therefore, in fuel injection system 200, high pressure fuel rail 16 is preferably not fluidly connected to fuel tank 13 at any time during the injection event. It should be appreciated that the total fuel consumed by fuel injection system 200 is still higher than the total fuel injected because an amount of fuel from high pressure fuel rail 16 is not injected, but instead acts on needle valve 90 within needle control chamber 88.

The fuel injection systems of the present invention have a number of advantages over prior art systems. Because the electronic control valves used in the present invention are located remote from the individual fuel injectors, the number of electronic control valves used in the fuel injection system can be reduced. For instance, because nozzle chamber 97 is always fluidly connected to high pressure fuel rail 16, injection can begin at full pressure. This is unlike those systems where the needle valve opens at a valve opening pressure that is well below a maximum injection pressure. With regard to fuel injection system 11, only one electronic control valve is used to control the injection of each fuel injector, instead of utilization of as many electronic control valves as the number of fuel injectors. In addition, fuel injection systems 100 and 200 allow for flexible rate shaping of the injection event. Further, because fuel injection system 200 has the ability to block fluid communication between the high pressure fuel rail and the fuel drain during an injection event, fuel injection system 200 consumes, and therefore wastes, less fuel than prior art fuel injection systems of this nature.

It should be understood that the above description is intended for illustrative purposes only, and is not intended to limit the scope of the present invention in any way. For instance, while the present invention does not include a switch between the pressure build-up electronic control valve and the fuel injectors, it should be appreciated that such a switch could be utilized. Further, while the fuel injection systems of the present invention include electronic control valves that are preferably solenoids, it should be appreciated that other suitable actuators, such as a piezoelectric actuator, could be substituted. Thus, those skilled in the art will appreciate that other aspects, objects and advantages of this invention can be obtained from a study of the drawings, the disclosure and the appended claims.

What is claimed is:

1. A fuel injector comprising:

an injector body with a needle control chamber disposed therein;

a direct control needle valve at least partially positioned in said injector body and including a closing hydraulic surface exposed to fluid pressure in said needle control chamber;

a flow restriction valve member at least partially positioned in said injector body and movable between a first position in which a nozzle supply passage is relatively restricted and a second position in which said nozzle supply passage is relatively unrestricted;

an unobstructed high pressure passage extending between said needle control chamber and outside said injector body; and an unobstructed low pressure passage extending between said needle control chamber and outside said injector body.

2. The fuel injector of claim 1 wherein said direct control needle valve includes an opening hydraulic surface exposed to fluid pressure in a nozzle supply passage, which is fluidly connected within said injector body to said high pressure passage.

3. The fuel injector of claim 1 wherein said flow restriction valve member includes a hydraulic surface exposed to fluid pressure in a pressure control passage.

4. The fuel injector of claim 1 wherein said injector body is free of electrical actuators attached thereto.

5. The fuel injector of claim 1 wherein said direct control needle valve includes an opening hydraulic surface exposed to fluid pressure in a nozzle supply passage, which is fluidly isolated within said injector body from said high pressure passage.

6. The fuel injector of claim 1 wherein said injector body is free of electrical actuators attached thereto.

7. The fuel injector of claim 6 wherein said direct control needle valve includes an opening hydraulic surface exposed to fluid pressure in said nozzle supply passage, which is fluidly connected within said injector body to said high pressure passage.

8. The fuel injector of claim 6 wherein said direct control needle valve includes an opening hydraulic surface exposed to fluid pressure in said nozzle supply passage, which is fluidly isolated within said injector body from said high pressure passage.

9. A method of injecting fuel comprising the steps of:

opening a nozzle outlet of a fuel injector at least in part by relieving pressure on a closing hydraulic surface of a direct control needle valve;

restricting fuel flow to said nozzle outlet at least in part by positioning a flow restriction valve member in a first position;

unrestricting fuel flow to said nozzle outlet at least in part by positioning said flow restriction valve member in a second position; and closing said nozzle outlet at least in part by increasing pressure on said closing hydraulic surface of said direct control needle valve.

10. The method of claim 9 wherein said flow restriction valve member is moved in one direction between said first position and said second position by applying a hydraulic force to one end of said flow restriction valve member.

11. The method of claim 10 including a step of biasing said flow restriction valve member in a direction opposite to said one direction.

12. The method of claim 11 wherein one of said restricting step and said unrestricting step includes energizing an electrical actuator located remotely from said fuel injector.

13. The method of claim 9 wherein at least one of said opening step and said closing step includes energizing an electrical actuator located remotely from said fuel injector.

14. The method of claim 9 including a step of coupling a plurality of fuel injectors to a common electrical actuator.

15. A fuel injection system comprising:

a high pressure fuel rail;

a low pressure fuel drain;

a plurality of fuel injectors that each include a direct control needle valve with a needle valve member having a closing hydraulic surface exposed to fluid pressure in a needle control chamber; and a common electrical actuator coupled to each said direct control needle valve of said plurality of fuel injectors and being operable to vary fluid pressure in said needle control chamber.

16. The fuel injection system of claim 15 wherein said plurality of fuel injectors are free from electrical actuators attached thereto.

17. A fuel injection system comprising:

a high pressure fuel rail;

a low pressure fuel drain;

a plurality of fuel injectors that each include a direct control needle valve;

a first common electrical actuator coupled to said plurality of fuel injectors; and a second common electrical actuator coupled to said plurality of injectors.

18. The fuel injection system of claim 17 including a third common electrical actuator coupled to said plurality of fuel injectors.

19. A fuel injection system comprising:

a high pressure fuel rail;

a low pressure fuel drain;

a plurality of fuel injectors that each include a direct control needle valve;

a common electrical actuator coupled to said plurality of fuel injectors; and each of said plurality of fuel injectors includes a flow restriction valve member movable between a first position in which a nozzle supply passage is relatively restricted, and a second position in which said nozzle supply passage is relatively unrestricted.

* * * * *